US008939002B2

(12) United States Patent
Yamamoto

(10) Patent No.: US 8,939,002 B2
(45) Date of Patent: Jan. 27, 2015

(54) EXTRUSION PRESS DEVICE

(75) Inventor: Takeharu Yamamoto, Ube (JP)

(73) Assignee: Ube Machinery Corporation, Ltd. (JP)

( * ) Notice: Subject to any disclaimer, the term of this patent is extended or adjusted under 35 U.S.C. 154(b) by 683 days.

(21) Appl. No.: 13/201,649

(22) PCT Filed: Jan. 27, 2010

(86) PCT No.: PCT/JP2010/051456

§ 371 (c)(1),
(2), (4) Date: Aug. 16, 2011

(87) PCT Pub. No.: WO2010/098180

PCT Pub. Date: Sep. 2, 2010

(65) Prior Publication Data

US 2011/0296889 A1 Dec. 8, 2011

(30) Foreign Application Priority Data

Feb. 26, 2009 (JP) ..... 2009-043249
May 28, 2009 (JP) ..... 2009-128385

(51) Int. Cl.
*B21C 27/00* (2006.01)
*B21C 23/21* (2006.01)
*B21C 27/04* (2006.01)

(52) U.S. Cl.
CPC ..... *B21C 27/00* (2013.01); *B21C 27/04* (2013.01)
USPC ..... 72/272; 72/273

(58) Field of Classification Search
USPC ..... 72/253.1, 257, 270–272, 273
See application file for complete search history.

(56) References Cited

U.S. PATENT DOCUMENTS 4,825,677 A 5/1989 Bessey et al.
5,678,442 A * 10/1997 Ohba et al. ..... 72/272
5,823,038 A 10/1998 Jakoby
5,896,772 A * 4/1999 Izumi ..... 72/272

FOREIGN PATENT DOCUMENTS

JP 52-9189 B2 3/1977
JP 63-132717 6/1988
JP 04-135012 5/1992
JP 09-057335 3/1997
JP 09-094608 4/1997
JP 09-122740 5/1997
JP 9-314220 12/1997
JP 10-137840 5/1998
JP 10-156426 6/1998

* cited by examiner

*Primary Examiner* — Debra Sullivan
(74) *Attorney, Agent, or Firm* — DLA Piper LLP (US)

(57) ABSTRACT

A two-split seal block is enabled, when closed, to come into close contact with an abutment surface of the seal block and an outer circumferential surface of an extrusion stem or fix dummy block via a seal member pasted to the abutment surface of the seal block and a seal member provided on an inner circumferential surface of the seal block and a pressing means capable of pressing and causing a seal member provided on a container side end surface of the seal block against and to come into close contact with a stem side end surface of the container is provided movably in the extrusion direction, and the seal block is provided so as to be capable of opening and closing by rocking in a direction crossing the axial direction of the extrusion stem and at the same time, the seal block is provided so as to be capable of moving in the direction crossing the axial direction of the extrusion stem in an open state.

4 Claims, 6 Drawing Sheets

EXTRUSION PRESS DEVICE

CROSS-REFERENCE TO RELATED APPLICATIONS

The present invention takes priority from Japanese Patent Application No. 2009-043249 filed on Feb. 26, 2009 and Japanese Patent Application No. 2009-128385 filed on May 28, 2009, the entire contents of which are expressly incorporated herein as reference and continued in the subject application.

TECHNICAL FIELD

The present invention relates to an improved extrusion press device, in which a two-split seal block having a structure attachable to and detachable from a fix dummy block is closed at the time of extrusion molding of aluminum alloy, etc., by an extrusion press and after a seal member arranged on the container side of the seal block is pressed by a pressing means and before a billet is extruded, air between the container and the billet is discharged to the outside of the container so that the billet does not take in air, and thus, the billet is extruded effectively and without waste.

BACKGROUND ART

After a billet having a diameter smaller than the inner diameter of a container is sandwiched between an extrusion stem and a die and loaded into the container, when the billet is pressed against the die by the extrusion stem within the container, i.e., upset, the billet is crushed and air between the container and the billet is compressed. The extrusion stem and the container are slightly retracted to discharge the compressed air to the outside of the container and the above-mentioned compressed air is drained through a gap between the die and the container, and then, the container and the extrusion stem are advanced again to start extrusion. A degassing step of draining the compressed air in this manner is referred to as a burp cycle and due to this step, there occurs a step wasteful to the extrusion cycle.

In this method, when deaeration is performed in the burp cycle and the container is pressed against the die, air remains at the atmospheric pressure in a thin layer like a skin between the inner surface of the container and the outer surface of the billet, indicating that sufficient deaeration is not performed.

As a conventional deaeration device of an extrusion press device capable of easily and securely removing the residual air at the time of extrusion of a billet, there is such a device disclosed in, for example, Patent Literature 1, Patent Literature 2, and Patent Literature 3.

In Patent Literature 1, a method is described, by which air within a container is sucked and deaerated through an exhaust hole by comprising a container liner provided with a protrusion in the shape of a ring on the stem side end surface of the container into which a billet is loaded and a two-split seal block that can be opened/closed in a direction crossing the axial direction of the extrusion stem and which has an exhaust hole through which air that remains within the container is discharged, and causing the seal block to come into close contact with the outer circumferential surface of the ring-shaped protruding part and the outer circumferential surface of the extrusion stem at the same time to seal when closing the seal block.

In Patent Literature 2 or 3, a method is described, by which air within a container is sucked and deaerated through an exhaust hole by comprising a container liner provided with a protrusion in the shape of a ring on the stem side end surface of the container into which a billet is loaded and a two-split seal block that can be opened/closed in a direction crossing the axial direction of the extrusion stem and which has an exhaust hole through which air that remains within the container is discharged, enabling the seal block to come into close contact with the side end surface of the ring-shaped protrusion and the outer circumferential surface of the extrusion stem at the same time via a seal member pasted to the seal block when closing the seal block, and causing a pressing means to press the seal member pasted to the ring-shaped protrusion side of the seal block against the side end surface of the ring-shaped protrusion in the extrusion direction to seal.

Then, any of the above-mentioned conventional deaeration devices is configured so that each of the two-split seal blocks moves in both opposite directions along a guide attached to the upper part and the lower part of the container end surface on the extrusion stem side and opens and closes (horizontal movement in both directions on the extrusion press operation side and the opposite side of the operation side). Further, the retracted position when the seal block is released is set to a position where there is no interference with a billet loader that mounts a billet to be loaded into the container and replacement of the container liner with another is not impeded.

A billet is supplied into the container of the normal extrusion press device by a billet loading means after retracting the extrusion stem upon composition of extrusion and moving the billet loader that mounts the billet into a gap between the end surface of the container and the end surface of the retracted extrusion stem.

In the extrusion press device that supplies a billet into the container using a direct type billet loader that supplies a billet to the extrusion press device in a direction crossing the axis of the extrusion press and in a direction horizontal with the axis and which uses the conventional deaeration device configured as described above, when the billet loader is provided on the operation side of the extrusion press or the opposite side of the operation side, the billet loader is also arranged in a position where interference with the deaeration device is avoided.

In order to avoid interference between the billet loader and the deaeration device, it is necessary to secure a gap by extending the extrusion stroke, and therefore, the facilities increase in size and at the same time, the extrusion cycle time is lengthened.

Further, a billet is transferred to and installed on the billet loader by a billet transfer device and a billet carrier is also arranged in a position where interference with the deaeration device in a direction crossing the axis of the extrusion press is avoided.

In order to avoid the interference between the billet transfer device and the deaeration device, it is necessary to lengthen the moving stroke to the extrusion press device of the billet loader, and therefore, the facilities increase in size and at the same time, the billet supply time is lengthened. Then, an increase in size of the facilities impedes the pace productivity.

In order to supply a billet into a container of a rear loading type short stroke extrusion press device, in which after extrusion is completed, the extrusion stem retracts and then moves to secure a gap through which a billet is supplied, a direct type billet loader is used mainly, which comprises an inserter (inserting means) of a billet and performs loading in a direction crossing the axis of the extrusion press device and at the same time in a direction horizontal with the axis.

When the conventional deaeration device is used in the rear loading type short stroke extrusion press device configured as described above and the billet loader is provided on either the operation side of the extrusion press device or the opposite side of the operation side, the billet loader is also arranged in a position where interference with the deaeration device is avoided.

In order to avoid the interference between the billet loader and the deaeration device, it is necessary to secure a gap by extending the extrusion stroke, and therefore, the facilities increase in size and at the same time, the extrusion cycle time is lengthened.

Further, a billet is transferred to and installed on the billet loader by the billet transfer device and the billet carrier is also arranged in a position where interference with the deaeration device in the direction crossing the axis of the extrusion press device is avoided.

In order to avoid the interference between the billet transfer device and the deaeration device, it is necessary to lengthen the moving stroke to the extrusion press device of the billet loader, and therefore, the facilities increase in size and at the same time, the billet supply time is lengthened. Then, an increase in size of the facilities results in excessive occupation of the installation area and the space productivity is impeded.

A billet is supplied into the container of a front loading type short stroke extrusion press device by retracting the extrusion stem and the container upon completion of extrusion, moving forward the billet loader that mounts the billet into the gap between the die side end surface of the container and the die end surface, causing the billet to be sandwiched between the end surface of the extrusion stem and the die end surface by moving forward the extrusion stem, and then moving forward the container.

Then, a billet is supplied into the extrusion press device by using a direct type billet loader capable of moving in the direction crossing the axis of the extrusion press, comprising a clamper (gripping means) of the billet, and capable of moving in the horizontal direction, and the billet loader is provided on either the operation side of the extrusion press device or the opposite side of the operation side.

A billet is transferred to the billet loader by the billet transfer device and the billet transfer device is also arranged in a position where interference with the deaeration device is avoided and in parallel with the axis of the extrusion press device.

In this case, in order to avoid interference between the billet transfer device and the deaeration device, it is necessary to lengthen the moving stroke of the billet loader to the extrusion press device, and therefore, the facilities increase in size and at the same time, the billet supply time is lengthened. Then, an increase in the size of the facilities impedes the pace productivity as a result.

Further, the container cylinder is attached to the main cylinder side so as not to interfere with the billet loader and at the same time, provided in a pair on both the outsides of the extrusion press so as not to interfere when the container is replaced with another. With such a configuration, it is not possible to avoid interference between the deaeration device and the rod of the container cylinder.

Furthermore, in the short stroke extrusion press device of this type, in order to avoid interference between the outer diameter of the billet and the container inner diameter when the billet is inserted into the container, the inner diameter of the container is set larger than that of the extrusion press of other types. Because of this, there used to be the possibility of a larger amount of air involved in the billet at the time of upset of the billet.

CITATION LIST

[Patent Literature (PTL) 1] Japanese Unexamined Patent Publication (Kokai) No. 9-57335

[Patent Literature (PTL) 2] Japanese Unexamined Patent Publication (Kokai) No. 10-156426

[Patent Literature (PTL) 3] Japanese Unexamined Patent Publication (Kokai) No. 10-137840

SUMMARY OF INVENTION

Technical Problem

The present invention has been made in order to solve the problems and an object thereof is to provide an extrusion press device that improves productivity of extruded products of excellent quality and at the same time, which improves space productivity by minimizing the installation space of the facilities without the need to extend the extrusion stroke or to extend the moving stroke of a billet loader to the extrusion press device even when a direct type billet loader is used.

Another object of the present invention is to provide an extrusion press device that improves productivity of extruded products of excellent quality and at the same time, which improves space productivity by minimizing the installation space of the facilities without the need to extend the moving stroke of a billet loader to the extrusion press device and without impeding the installation space of a container cylinder even when a direct type billet loader capable of moving in the horizontal direction is used.

Solution to Problem

In order to achieve the above-mentioned objects, an extrusion press device in a first embodiment of the present invention is characterized by being an extrusion press device in which a two-split seal block is enabled, when closed, to come into close contact with an abutment surface of the seal block and an outer circumferential surface of an extrusion stem or fix dummy block via a seal member pasted to the abutment surface of the seal block and a seal member provided on an inner circumferential surface of the seal block and a pressing means capable of pressing and causing a seal member provided on a container side end surface of the seal block against and to come into close contact with a stem side end surface of the container is provided movably in the extrusion direction, and also characterized by providing the seal block so as to be capable of opening and closing by rocking in a direction crossing the axial direction of the extrusion stem and at the same time, providing the seal block so as to be capable of moving in the direction crossing the axial direction of the extrusion stem in an open state.

An extrusion press device in a second embodiment of the present invention is characterized in that the direction of the forward movement of the seal block is set to a direction in opposition to the direction of the billet supply of the billet loader that mounts a billet to be loaded to the container in the extrusion press device in the first embodiment.

An extrusion press device in a third embodiment of the present invention is characterized in that the seal block is provided with an exhaust hole through which residual air within a container is exhausted and the exhaust hole is communicated with a vacuum pump in the extrusion press device in the first or second embodiment.

An extrusion press device in a fourth embodiment of the present invention is characterized by being an extrusion press device in which a direct type billet loader is provided, which is arranged so as to be capable of entering and exiting between a die and a container and which transfers a billet to a billet loading opening of the container, a two-split seal block is enabled, when closed, to come into close contact with the abutment surface of the seal block and an outer circumferential surface of an extrusion stem or fix dummy block via a seal member pasted to the abutment surface of the seal block and a seal member provided on an inner circumferential surface of the seal block, and a pressing means capable of pressing and causing a seal member provided on the container side end surface of the seal block against and to come into close contact with a stem side end surface of the container is provided movably in the extrusion direction, and also characterized by providing the seal block so as to capable of opening and closing by rocking in a direction crossing the axial direction of the extrusion stem and at the same time, providing the seal block as to be capable of moving in the direction crossing the axial direction of the extrusion stem in an open state.

An extrusion press device in a fifth embodiment of the present invention is characterized in that the direction of the forward movement of the seal block is set to a direction in opposition to the direction of the billet supply of the billet loader that mounts a billet to be loaded to the container in the extrusion press device in the fourth embodiment.

An extrusion press device in a sixth embodiment of the present invention is characterized in that the seal block is provided with an exhaust hole through which residual air within a container is exhausted and the exhaust hole is communicated with a vacuum pump in the extrusion press device in the forth or fifth embodiment.

Advantageous Effects of Invention

A configuration is set so that a seal block rocks and is opened into a two-split form and closed, and a seal member that seals the split surface of the seal block, a seal member that seals an outer circumferential surface of an extrusion stem, and a seal member that seals an end surface of a container are provided, wherein the seal block moves from a predetermined standby position to an extrusion press center position in one direction in a state of being released into a two-split form so that the seal member seals the outer circumferential surface of the extrusion stem and the split surface of the seal block and at the same time, the seal block moves in the extrusion direction to seal the end surface of the container. By the configuration in which a means for opening/closing the seal block and a means for moving the seal block are provided independently of each other, it is possible to install a deaeration device comprising the seal block on one of the operation side of the container and the opposite side of the operation side. Because of this, it is possible to reduce the width of the machine (i.e. extrusion press device) on any one of the sides on which the deaeration device is not arranged.

The direction of the forward movement of the two-split seal block is set to a direction in opposition to the direction of the billet supply of the billet loader. As described above, the deaeration device is not arranged on the same surface as the container end surface on the opposite side on which the deaeration device is installed, and therefore, it is possible to provide the billet loader in the proximity of the end surface of the container. Because of this, it is possible to provide the deaeration device in the extrusion press device without the need to extend the extrusion stroke.

The deaeration device is not arranged on the machine (extrusion press device) side on which it interferes with the billet transfer device, and therefore, it is possible to provide the transfer device in the proximity of the machine side. Because of this, it is possible to shorten the moving stroke of the direct type billet loader capable of moving in the horizontal direction to the extrusion press device and to shorten the billet supply time.

With the configuration described above, it is possible to make an attempt to prevent the facilities of the extrusion press device from increasing in size and to reduce the facility cost, and further, the installation area of the extrusion press device is reduced and the space productivity is improved.

Because of the compact configuration of the slide plate of the deaeration device, it is unlikely that it interferes with the rod of the container cylinder.

The two-split seal block is provided with an exhaust hole through which residual air within the container is exhausted and the exhaust hole is communicated with the vacuum pump. Due to this, it is possible to perform deaeration with a sufficient seal and a high degree of vacuum. Further, it is not necessary to perform the burp cycle as conventionally, and therefore, it is possible to shorten the extrusion cycle time. Further, it is possible to obtain an extrusion-molded product of high quality with high yields by preventing blisters from entering mixedly.

In the short stroke extrusion press device of a front loading type, the container is deaerated by making use of the characteristics that the billet does not come into contact with the inner wall of the container when the billet is inserted into the container, and therefore, it is possible to expect a smaller amount of air that enters mixedly than that of the conventional of rear loading type extrusion press product.

The present invention may be more fully understood from the description of the preferred embodiments of the invention set forth below, together with the accompanying drawings.

DESCRIPTION OF EMBODIMENTS

Embodiments of an extrusion press device of the present invention are explained with reference to the drawings.

Figure 1:
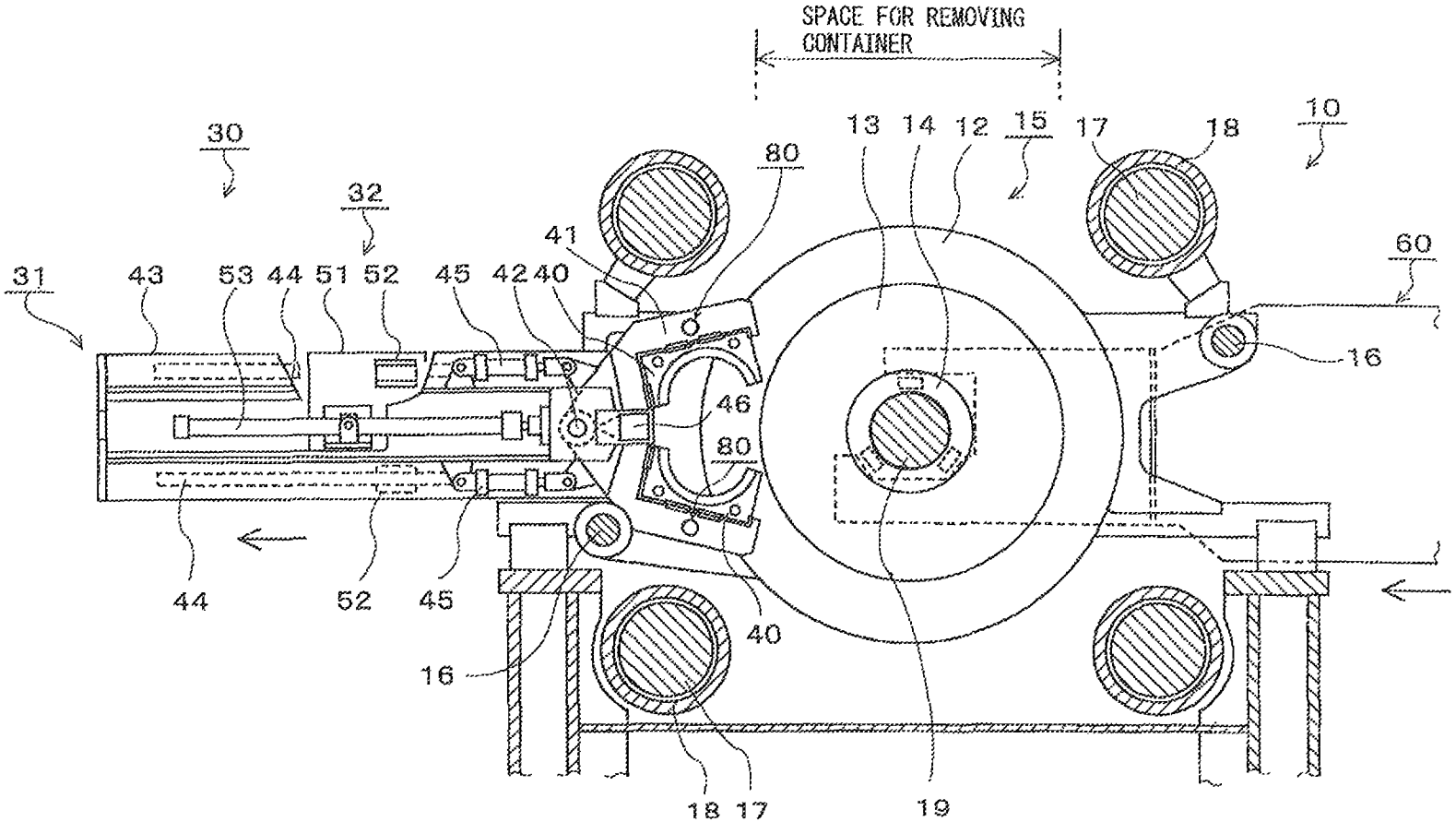
FIG. 1 is a diagram for explaining a general configuration according to the present invention, a front view when a seal block is located in a retracted position.

As shown in FIG. 1, for an end platen, not shown schematically, of an extrusion press device 10, a container 15 composed of a container holder 12, a container tire 13, and a container liner 14 is equipped and provided so as to be capable of moving back and forth in the direction of the extrusion axis by a container cylinder, not shown schematically.

A deaeration device 30 that deaerates compressed air within a container that occurs at the time of upset is basically composed of a seal means 31 and a moving means 32 of the seal means 31 and arranged on an end surface on the extrusion stem side of the container 15 so as to be capable of moving horizontally. Reference numeral 60 is a direct type billet loader, which loads a billet into the extrusion press device 10, comprises a billet gripping means 63, is capable of moving in the horizontal direction and is provided in symmetry with the axis of the extrusion press device 10 so as to move forward in opposition to the direction of the forward movement of the deaeration device 30 (in the direction of the center of the extrusion press).

FIG. 1 shows a state where the deaeration device 30 has moved back to a predetermined position and the billet loader 60 has moved horizontally to the center position of the extrusion press device 10 to supply the billet 61 into the container 15.

Reference numeral 17 is a tie bar that couples the end platen and the main cylinder of the extrusion press device 10, 18 is a pre-compressed tube, and 19 is an extrusion stem. Then, reference numeral 16 is a piston rod of the container cylinder.

In this configuration, the deaeration device 30 is provided on the stem side end surface of the container 15 and the billet loader 60 is arranged so as to be capable of moving back and forth between the die side end surface of the container 15 and the die end surface.

The essential parts of the seal means 31 are composed of a seal block 40, a seal block holding member 41, a fixed axis 42, a slide plate 43, a guide 44, an open/close cylinder 45, a press cylinder 46, a pull-back means 80, etc.

The moving means 32 is basically composed of a base plate 51, a guide receiver 52, and a moving cylinder 53. The base plate 51 is attached to the end surface on the extrusion stem side of the container 12 and to which, the guide receiver 52 and the moving cylinder 53 are installed securely. The tip end of the cylinder rod of the moving cylinder 53 is fastened to the slide plate 43 of the seal means 31 via a connecting metal fitting and enables the back and forth movement of the seal means 31.

As shown in FIG. 1, to the slide plate 43 of the seal means 31, the guide 44 which is inserted into the guide receiver 52 is attached, which is supported pivotally by the fixed axis 42 so as to be capable of opening/closing by being rocked by the open/close cylinder 45 and seal block 40 which is inserted into the seal block holding member 41. The guide 44 is attached to the rear surface of the slide plate 43 and stably supports the movement of the slide plate 43 by moving slidably within the guide receiver 52 when the seal means 31 moves back and forth. The press cylinder 46 that moves the seal block 40 in the extrusion direction is provided at the center part of the tip end of the slide plate 43.

Figure 2:
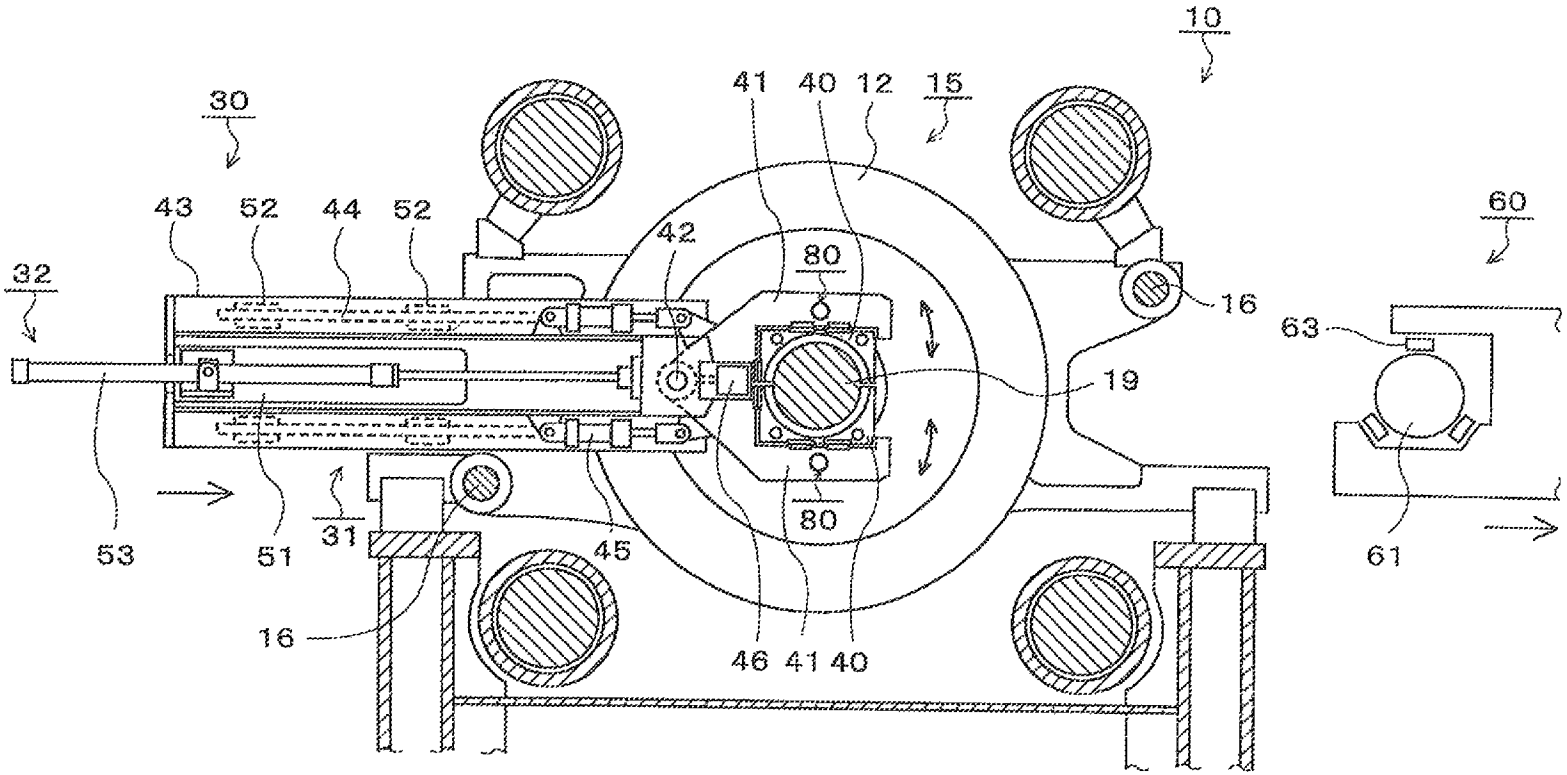
FIG. 2 is a front view when the seal block is in an advanced position.

FIG. 2 shows a state where the seal means 31 has moved forward by the moving cylinder 53, the seal block holding member 41 and the seal block 40 are located at the center of the extrusion press, and the billet loader 60 that has loaded the billet 61 into the container 12 has moved horizontally to a predetermined retracted position in the proximity of the machine (extrusion press device) side.

The seal block holding member 41 and the seal block 40 pivot around the fixed axis 42 as a center when the open/close cylinder 45 is operated and thus are made capable of opening/closing for a fix dummy block 20 provided at the extrusion stem 19 or the tip end of the extrusion stem 19.

Figure 3:
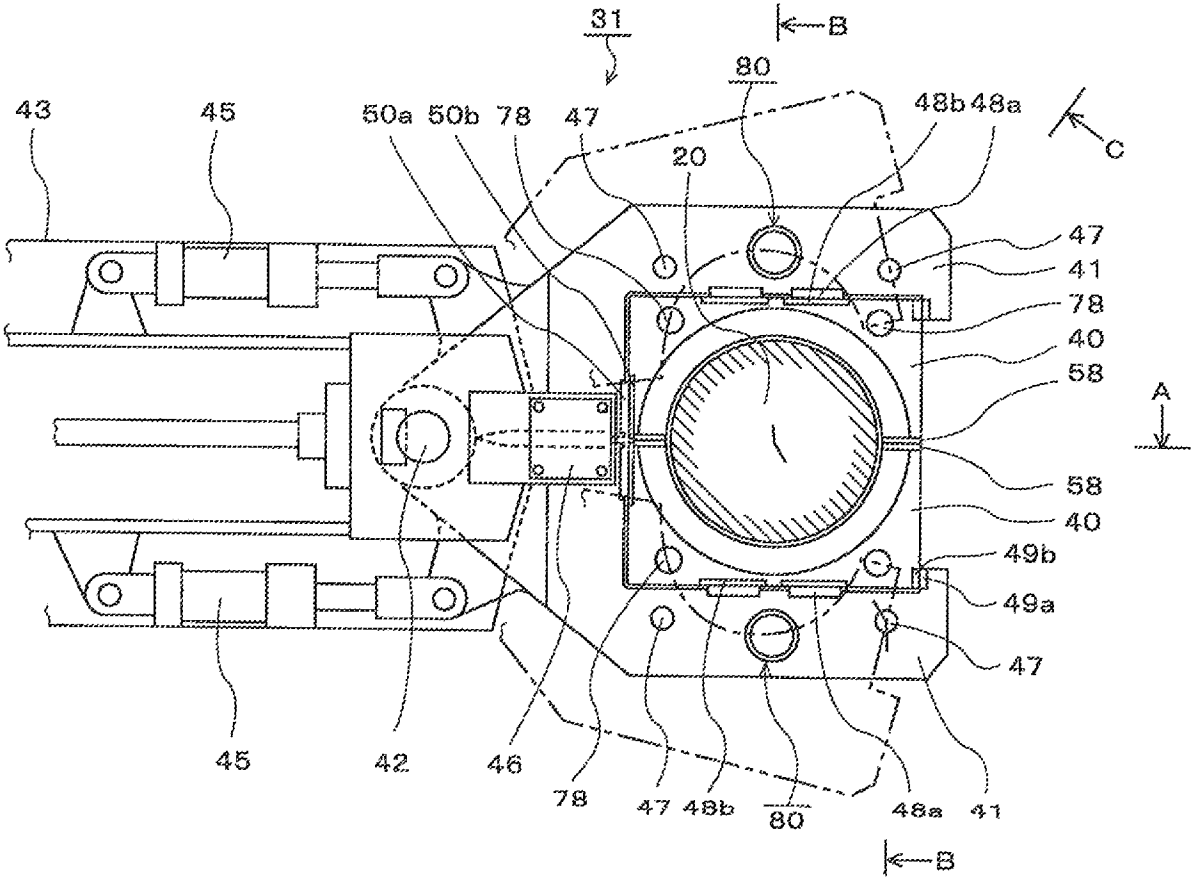
FIG. 3 is an enlarged view for explaining the opening/closing operation of the seal block.
Figure 4:
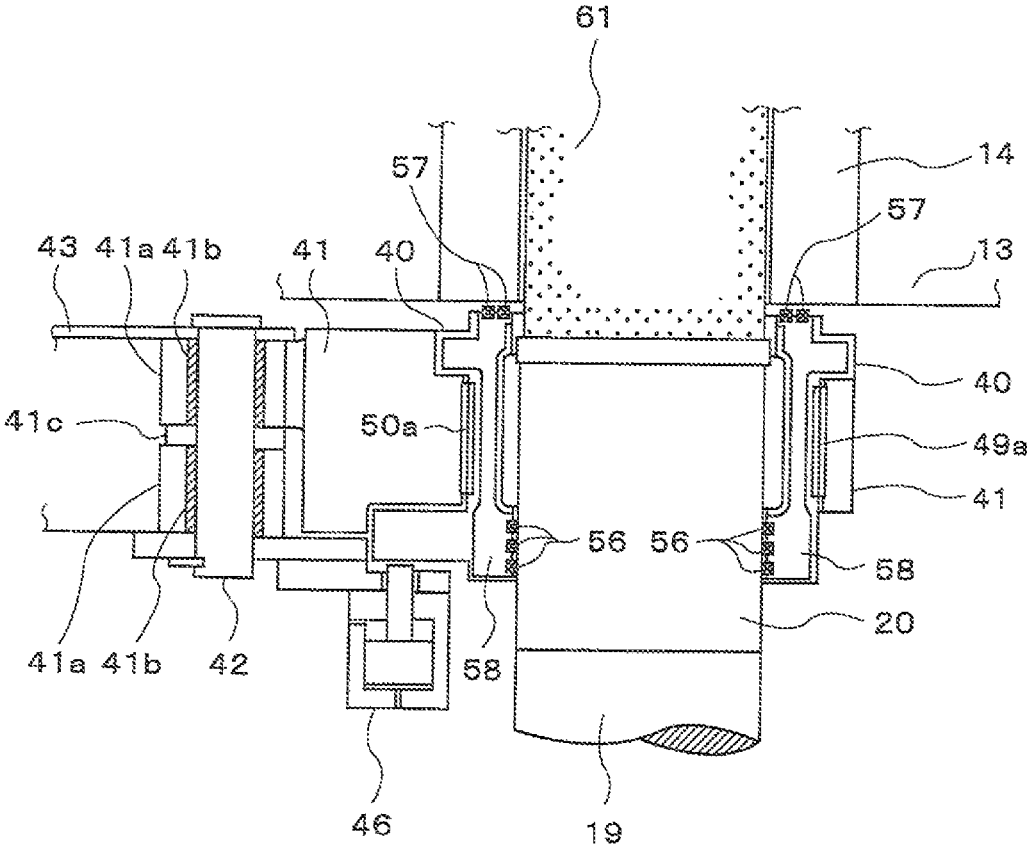
FIG. 4 is a sectional view when viewed in the direction of an arrow A in FIG. 3.

As shown in FIG. 3 and FIG. 4, the seal block 40 is driven by the open/close cylinder 45 and closed and seal members 56 of the extrusion stem 19 or the fix dummy block 20, which are provided on the inner circumferential surface of the seal block 40 come into close contact with the outer circumferential surface of the extrusion stem 19 or the fix dummy block 20 and at the same time, seal members 58 on the split surface pasted to the split surface of the seal block 40 come into close contact each other.

Then, the configuration is set so that the seal block 40 is provided with guide liners 48*b* to 50*b* and thereby supported and guided when moving in the extrusion direction by a guide axis 47 provided in the seal block holding member 41 and guide liners 48*a* to 50*a*. On container side end surface of the seal block 40, seal members 57 that seal the stem side end surface of the container 15 are provided.

The two-dot chain line in FIG. 3 shows a state where the seal block holding member 41 and the seal block 40 are released from the outer circumferential surface of the stem 19 and reference numeral 78 represents a deaeration hole through which the residual air within the container is discharged.

As shown in FIG. 4, the configuration is set so that a bearing bush 41*b* is fit into a bearing part 41*a* of the seal block holding member 41 and supported pivotally by the fixed axis 42 being inserted into the bearing bush 41*b*. The fixed axis 42 is fixed on the slide plate 43 by a key plate. Reference numeral 41C is a distance piece (separation plate of the bearing).

The closing operation of the seal block 40 is performed by causing the cylinder rod of the open/close cylinder 45 to operate in the pull-out direction (pressing operation of the cylinder) so that the seal block 40 at the upper side rocks clockwise about the fixed axis 42 and the seal block 40 at the lower side rocks counterclockwise, and the opening operation thereof is performed by causing the cylinder rod of the open/close cylinder 45 to operate in the pull-back direction (pulling operation of the cylinder). As described above, the configuration is set so that the opening/closing of the seal block 40 is performed by each of the two parts split vertically rocking in opposite directions about the fixed axis 42.

As shown in FIG. 4, by moving the seal block 40 in the closed state in the extrusion direction and pressing it against the stem side end surface of the container 15, the seal member 57 that seals the stem side end surface of the container 15 comes into close contact with the stem side end surface of the container liner 14. The press cylinder 46 is attached to the slide plate 43 and the cylinder rod of the press cylinder 46 is provided so as to be attachable/detachable to/from the seal block 40. By driving the press cylinder 46 and causing the seal block 40 to slide along the abutment surface of the guide liners 48*b* to 50*b* and the guide liners 48*a* to 50*b*, it is made possible for the seal block 40 to be pressed against the stem side end surface of the container 15. Reference numeral 58 is the seal members that seal the split surface of the seal block 40 by coming into close contact with each other when the seal block 40 is closed.

Figure 5:
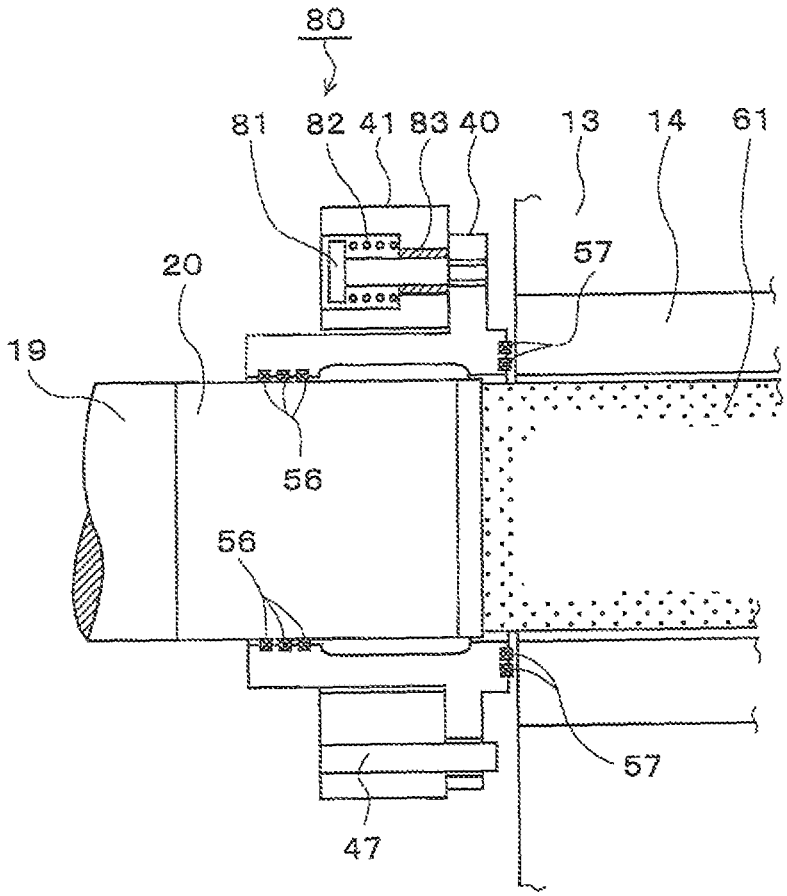
FIG. 5 is a sectional view along B-B in FIG. 3.

As shown in FIG. 5, the pull-back means 80 for pulling back the seal block 40 from the end surface on the extrusion stem side of the container 15 to a predetermined position is provided in the seal block holding member 41. The essential parts of the pull-back means 80 are composed of an axis 81 that is inserted into the seal block holding member 41, the tip end part of which is screwed up to the seal block 40, and which has a stepped portion at the end part, a coil spring 82 compressed when the axis 81 moves, and a bearing 83 that is fit into the seal block holding member 41 and which guides the movement of the axis 81. Reference numeral 47 is a guide axis of the seal block 40, which is fastened to the seal block holding member 41. By releasing the pressing force by the press cylinder 46, the seal block 40 can return to the original position by means of the restoring force of the compressed coil spring 82. FIG. 5 shows a state where the seal block 40 is in the returned position.

Figure 6:
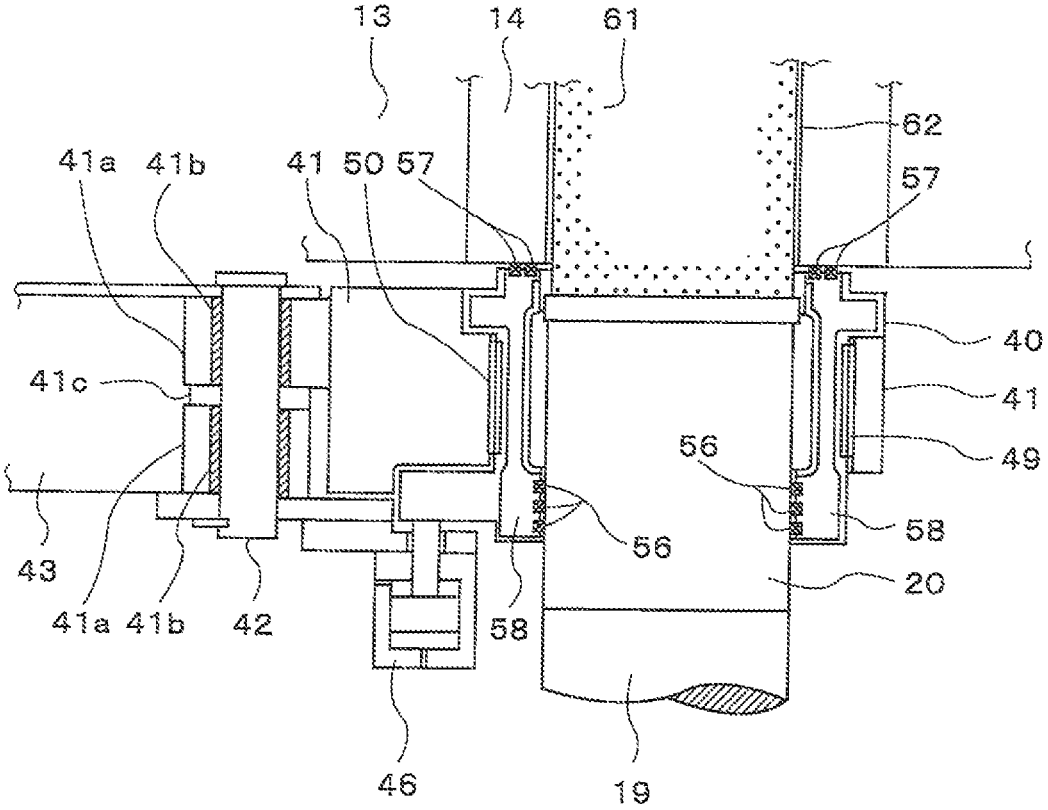
FIG. 6 is a sectional view when the seal block is pressed against a stem side end surface of a container.

As shown in FIG. 6, by causing the press cylinder 46 to exert a pressing force to move the seal block 40 in the closed state in the extrusion direction, the stem side end surface of the container 15 is sealed by the seal member 57 that seals the stem side end surface of the container 15.

In this manner, a deaerated space 62 is cut off from the outside by the seal member 56 that seals the outer circumferential surface of the fix dummy block, the seal member 57 that seals the stem side end surface of the container 15, and the seal member 58 that seals the split surface of the seal block. The deaerated space 62 is a cavity formed by the billet 61 and the container liner 14 and in which the billet is not in contact with the container inner wall and in the state shown in FIG. 6, the billet 61 is crushed by the operation to move the extrusion stem 19 in the extrusion direction, the so-called upset operation, and air within the deaerated space 62 is compressed.

Figure 7:
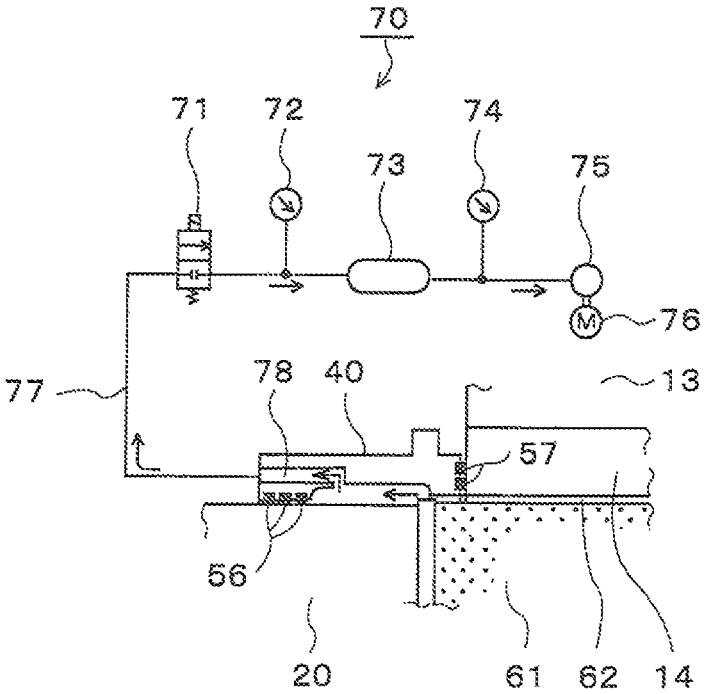
FIG. 7 is a sectional view when viewed in the direction of an arrow C in FIG. 3, an explanatory diagram showing a relationship with a vacuum pump.

Referring to FIG. 7, a configuration to discharge the residual air within the deaerated space 62 to the outside when performing the upset operation is explained.

A vacuum suction device 70 is basically composed of an electromagnetic valve 71, vacuum gages 72, 74, a vacuum tank 73, a vacuum pump 75, an electric motor 76, and a pipe 77. As shown in FIG. 6, the vacuum suction device 70 is activated in the state where the ventilation between the deaerated space 62 and the outside is cut off and the electromagnetic valve 71 is magnetized and the deaerated space 62 and the vacuum tank 73 are communicated with each other, and thereby, vacuum suction is performed.

The compressed air within the deaerated space 62 formed on the stem side of the container by the upset operation passes through a plurality of deaeration holes 78 provided in the seal block 40 and sucked and discharged to the vacuum tank 73 via the pipe 77 and the electromagnetic valve 71. In this manner, the compressed air within the deaerated space 62 is deaerated (or exhausted) to the outside quickly and sufficiently.

By the billet loader 60, the billet 61 is supplied between the die side end surface of the container 15 and the die end surface, the billet 61 is sandwiched between the stem end surface and the die end surface by the forward movement of the stem 19, and then by causing the billet loader 60 to move backward and at the same time causing the container 15 to move forward, the billet 61 is loaded into the container.

In the state where the container 15 has advanced and the die side end surface of the container 15 has come into contact with the die, the seal means 31 of the deaeration device 30 is caused to move forward. After that, the seal block 40 is closed and further, the seal block 40 is caused to move in the extrusion direction, and thereby, the deaerated space 62 and the vacuum suction device 70 are communicated with each other, and then the stem 15 is caused to move forward to perform upset and after a predetermined time elapses, the deaeration operation is started.

The completion of the deaeration operation is performed after a predetermined time elapses (for example, a state where the billet 61 is extruded about 20 to 30 mm from the initial length before the extrusion of the billet 61 is started) after the extrusion of the product, which is started accompanying the forward movement of the extrusion stem 19, is started upon the completion of the upset. At the same time, the pressing pressure to the end surface of the container 15 of the seal block 40 is released to release the seal block 40 by rocking as well as pulling back to the original position. Next, by driving the moving cylinder 53 of the moving means 32, the seal means 31 is moved to a predetermined retracted position of the extrusion press device 10 and stopped.

The extrusion press device 10 continues the extrusion operation after that and when extrusion is completed, the extrusion stem 19 and the container 15 are moved backward and billet 61 is supplied, and then the next cycle is entered.

As being obvious from the explanation above, in the present invention, the configuration is set so that the opening/closing means and the moving means of the two-split seal block are provided, respectively, and the opening and closing of the two-split seal block are performed by rocking it in opposition to each other.

Due to this, it is possible to arrange the deaeration device that discharges air remaining within the container on one of the side surfaces of the extrusion press device and in the extrusion press device comprising a direct type billet loader, it is possible to install the deaeration device without the need to extend the extrusion stroke and the quality of the extruded product is improved.

Due to this, it is possible to set a configuration in which the deaeration device is arranged on one of the side surfaces of the extrusion press device, and therefore, it is made possible to provide the billet transfer device that transfers a billet to the billet loader in the proximity of the machine side of the extrusion press device, and therefore, the moving stroke of the billet loader to the extrusion press device is shortened, the cycle time relating to billet supply can be shortened, and the productivity of the extrusion press device is improved.

Further, the appreciable effect is achieved that it is possible to improve the space productivity by minimizing the installation area of the facilities as well as downsizing the facilities, such as the extrusion press device and the billet loader and reducing the facility cost.

While the invention has been described by reference to specific embodiments chosen for the purposes of illustration, it should be apparent that numerous modifications could be made thereto, by those skilled in the art without departing from the basic concept and scope of the invention.

The invention claimed is:

1. An extrusion press device comprising:

a two-split seal block configured to be opened and closed by rocking in a direction crossing an axial direction of an extrusion stem, and to be linearly moved in the direction crossing the axial direction of the extrusion stem in an opened state thereof;

first seal members pasted to split surfaces of the seal block;

a second seal member provided on an inner circumferential surface of the seal block;

a third seal member provided on a container side end surface of the seal block; and a pressing means configured to move the seal block in the axial direction of the extrusion stem to cause the third seal member to closely contact a stem side end surface of the container, wherein, when the seal block is closed, the split surfaces of the seal block closely contact each other via the first seal members, and at the same time the inner circumferential surface of the seal block closely contacts an outer circumferential surface of the extrusion stem or a fixed dummy block via the second seal member, and wherein a direction of the linear movement of the seal block toward a center of the extrusion press device is arranged in an opposite direction to a direction of billet supply of a linear motion type billet loader that mounts a billet to be loaded into the container.

2. The extrusion press device according to claim 1, wherein the seal block is provided with an exhaust hole through which residual air within a container is exhausted and the exhaust hole is communicated with a vacuum pump.

3. An extrusion press device comprising:

a two-split seal block configured to be opened and closed by rocking in a direction crossing an axial direction of an extrusion stem, and to be linearly moved in the direction crossing the axial direction of the extrusion stem in an opened state thereof;

first seal members pasted to split surfaces of the seal block;

a second seal member provided on an inner circumferential surface of the seal block;

a third seal member provided on a container side end surface of the seal block;

a pressing means configured to move the seal block in the axial direction of the extrusion stem to cause the third seal member to closely contact a stem side end surface of the container; and a linear motion type billet loader configured to be capable of entering and exiting between a die and a container and transfer a billet to a billet loading opening of the container, wherein, when the seal block is closed, the split surfaces of the seal block closely contact each other via the first seal members, and at the same time the inner circumferential surface of the seal block closely contacts an outer circumferential surface of the extrusion stem or a fixed dummy block via the second seal member, and wherein a direction of the linear movement of the seal block toward a center of the extrusion press device is arranged in an opposite direction to a direction of billet supply of the linear motion type billet loader.

4. The extrusion press device according to claim 3, wherein the seal block is provided with an exhaust hole through which residual air within a container is exhausted and the exhaust hole is communicated with a vacuum pump.

* * * * *